US010464646B2

(12) United States Patent
Mizushima et al.

(10) Patent No.: US 10,464,646 B2
(45) Date of Patent: Nov. 5, 2019

(54) OUTBOARD MOTOR AND MARINE VESSEL

(71) Applicant: YAMAHA HATSUDOKI KABUSHIKI KAISHA, Iwata-shi, Shizuoka (JP)

(72) Inventors: Yoshihiro Mizushima, Shizuoka (JP); Takeshi Naito, Shizuoka (JP); Makoto Morino, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/862,666

(22) Filed: Jan. 5, 2018

(65) Prior Publication Data

US 2018/0222562 A1 Aug. 9, 2018

(30) Foreign Application Priority Data

Feb. 9, 2017 (JP) ..... 2017-021924

(51) Int. Cl.

| | |
|---|---|
| ***B63H 20/02*** | (2006.01) |
| ***B63H 20/00*** | (2006.01) |
| ***B63H 20/14*** | (2006.01) |
| ***B63H 20/10*** | (2006.01) |

(52) U.S. Cl.

CPC ..... *B63H 20/02* (2013.01); *B63H 20/10* (2013.01); *B63H 20/14* (2013.01); *B63H 2020/003* (2013.01); *B63H 2020/008* (2013.01)

(58) Field of Classification Search

CPC ..... B63H 20/02; B63H 2020/003; B63H 2020/008; B63H 20/32; B63H 20/14; B63H 20/10; B63H 2021/216; F02B 75/007; F02B 61/045; F02D 41/266; F02D 2400/14; F02D 2400/18

See application file for complete search history.

(56) References Cited

U.S. PATENT DOCUMENTS

| | | | | |
|---|---|---|---|---|
| 5,988,130 | A * | 11/1999 | Nakamura | F02P 11/00 123/179.5 |
| 6,446,593 | B1 | 9/2002 | Suganuma | |
| 6,450,847 | B1 | 9/2002 | Kashima et al. | |
| 6,595,179 | B1 * | 7/2003 | Kanno | F02B 61/045 123/198 D |
| 2007/0082567 | A1 | 4/2007 | Okuyama | |
| 2008/0119095 | A1 | 5/2008 | Hiroshima et al. | |
| 2014/0007839 | A1 * | 1/2014 | Inoue | F02D 43/00 123/406.47 |

FOREIGN PATENT DOCUMENTS

| | | | |
|---|---|---|---|
| JP | 6-129258 | A | 5/1994 |
| JP | 2006-044599 | A | 2/2006 |
| JP | 2007-008329 | A | 1/2007 |
| JP | 2007-91014 | A | 4/2007 |
| JP | 2010-14125 | A | 1/2010 |

* cited by examiner

*Primary Examiner* — Anthony D Wiest

(74) *Attorney, Agent, or Firm* — Keating and Bennett, LLP

(57) ABSTRACT

In an outboard motor, one of an engine control unit and a power supply control unit is mounted on a first side surface of an engine, and the other of the engine control unit and the power supply control unit is mounted on an upper surface of the engine.

18 Claims, 4 Drawing Sheets

OUTBOARD MOTOR AND MARINE VESSEL

CROSS REFERENCE TO RELATED APPLICATIONS

This application claims the benefit of priority to Japanese Patent Application No. 2017-021924 filed on Feb. 9, 2017. The entire contents of this application are hereby incorporated herein by reference.

BACKGROUND OF THE INVENTION

1. Field of the Invention

The present invention relates to an outboard motor including an engine and a control unit and a marine vessel including the outboard motor.

2. Description of the Related Art

An outboard motor including an engine and a control unit is known in general. Such an outboard motor is disclosed in Japanese Patent Laid-Open No. 6-129258, for example.

Japanese Patent Laid-Open No. 6-129258 discloses an outboard motor including an engine housed in an engine case (cowling) and a control unit totally disposed on a side surface of the engine. Recently, the size of a control unit is increased due to its high functionality.

In the outboard motor described in Japanese Patent Laid-Open No. 6-129258, the control unit is totally disposed on the side surface of the engine, and thus the control unit disadvantageously interferes with the engine case that faces the side surface of the engine or members (such as intake pipes through which intake air is supplied to the engine) inside the engine case disposed in the vicinity of the side surface of the engine due to an increase in the size of the control unit. Therefore, it is disadvantageously necessary to increase the size of the engine case (cowling) in order to prevent the interference. This problem should be solved since it is difficult to mount a plurality of outboard motors including large-size cowlings on a vessel body when the plurality of outboard motors are mounted adjacent to each other on the vessel body.

SUMMARY OF THE INVENTION

Preferred embodiments of the present invention provide outboard motors that significantly reduce or prevent an increase in the size of a cowling even when the total size of a control unit increases, and marine vessels including the outboard motors.

An outboard motor according to a preferred embodiment of the present invention includes an engine including a cylinder that reciprocates in a horizontal or substantially horizontal direction, a cowling that covers the engine, and a control unit including an engine control unit including a first controller including a semiconductor device, and a power supply control unit configured or programmed to communicate with the engine control unit and including a second controller including a semiconductor device. One of the engine control unit and the power supply control unit is mounted on a first side surface of the engine, and the other of the engine control unit and the power supply control unit is mounted on an upper surface of the engine.

In an outboard motor according to a preferred embodiment of the present invention, the control unit includes the engine control unit and the power supply control unit.

Furthermore, the one of the engine control unit and the power supply control unit is mounted on the first side surface of the engine, and the other of the engine control unit and the power supply control unit is mounted on the upper surface of the engine. Accordingly, only one of the engine control unit and the power supply control unit, which are elements of the control unit, is disposed on the first side surface of the engine, and thus interference of the cowling and members inside the cowling with the control unit in the vicinity of the first side surface of the engine is significantly reduced or prevented. Furthermore, the control unit is separated into the engine control unit and the power supply control unit such that the separated components of the control unit are each located in a relatively small empty space between the engine and the cowling or the members inside the cowling and are mounted on the engine as compared with the case where the engine control unit and the power supply control unit are integral and unitary with each other. Consequently, an increase in the size of the cowling is significantly reduced or prevented. This advantageous effect is particularly beneficial when a plurality of outboard motors are mounted on a vessel body since the plurality of outboard motors are able to be easily mounted on the vessel body.

In an outboard motor according to a preferred embodiment of the present invention, the other of the engine control unit and the power supply control unit is mounted on the upper surface of the engine. Accordingly, unlike the case where the other of the engine control unit and the power supply control unit is mounted on the inner surface of an upper portion of a flywheel cover, the flywheel cover is detached to expose the engine without detaching a cable connected to the other of the engine control unit and the power supply control unit, for example. Consequently, maintenance of the outboard motor such as maintenance of the engine is easily performed.

In an outboard motor according to a preferred embodiment of the present invention, the other of the engine control unit and the power supply control unit is preferably mounted at a location on the upper surface of the engine that corresponds to the cylinder of the engine. Accordingly, the other of the engine control unit and the power supply control unit is mounted at a relatively flat position that corresponds to the cylinder of the engine such that the other of the engine control unit and the power supply control unit is securely mounted on the engine.

In an outboard motor according to a preferred embodiment of the present invention, the other of the engine control unit and the power supply control unit is preferably mounted on the upper surface of the engine via a rubber vibration isolator and a bracket. Accordingly, the rubber vibration isolator significantly reduces or prevents direct transmission of vibrations due to the reciprocation of the cylinder, for example, to the other of the engine control unit and the power supply control unit. Thus, the other of the engine control unit and the power supply control unit including a semiconductor device having a relatively low resistance to vibration is protected. In addition, the other of the engine control unit and the power supply control unit is securely mounted on the engine via the rubber vibration isolator and the bracket regardless of the shape of the engine.

In an outboard motor according to a preferred embodiment of the present invention, the engine is preferably a V-shaped engine, and the other of the engine control unit and the power supply control unit is preferably disposed on the upper surface of the V-shaped engine so as to extend over a portion of the V-shaped engine that diverges in a V-shape in a planar view. Accordingly, the diverging portion of the V-shaped engine is used to ensure a large mounting area for the other of the engine control unit and the power supply control unit, and thus the other of the engine control unit and the power supply control unit is easily mounted on the engine even when the other of the engine control unit and the power supply control unit is relatively large.

An outboard motor according to a preferred embodiment of the present invention further includes a power generator disposed above the engine and that generates electricity due to a drive force of the engine, and an upper end of the other of the engine control unit and the power supply control unit is preferably located below an upper end of the power generator. Accordingly, upward protrusion of the other of the engine control unit and the power supply control unit from the power generator is significantly reduced or prevented, and thus increases in the sizes of the cowling and the outboard motor in an upward-downward direction are significantly reduced or prevented.

An outboard motor according to a preferred embodiment of the present invention preferably further includes a power generator that generates electricity due to a drive force of the engine and a rectification unit including a rectification controller including a semiconductor device and that is configured or programmed to perform control of rectifying the electricity generated by the power generator, and the rectification unit is preferably mounted on a second side surface different from the first side surface on which the one of the engine control unit and the power supply control unit is mounted. Accordingly, a mounting area for the engine control unit or the power supply control unit is ensured on the first side surface or the upper surface as compared with the case where the rectification unit is mounted on the first side surface or the upper surface on which the engine control unit or the power supply control unit is mounted. Consequently, even when the control unit is separated into the engine control unit and the power supply control unit, the engine control unit and the power supply control unit are easily mounted on the first side surface and the upper surface of the engine.

An outboard motor according to a preferred embodiment of the present invention preferably further includes a communication cable that communicably connects the engine control unit to the power supply control unit, and the engine control unit and the power supply control unit are preferably configured or programmed to communicate with an external control unit provided outside an outboard motor body via the communication cable. Accordingly, the engine control unit and the power supply control unit communicate not only with each other but also with the external control unit. Consequently, the external control unit, the engine control unit, and the power supply control unit transmit and receive information to and from each other and are able to reflect the information in control of each of the external control unit, the engine control unit, and the power supply control unit.

In a structure in which the engine control unit and the power supply control unit communicate with the external control unit, the external control unit preferably includes a steering control unit including a semiconductor device and that is configured or programmed to perform steering control of the outboard motor body with respect to a vessel body. Accordingly, the steering control unit, the engine control unit, and the power supply control unit transmit and receive information to and from each other and are able to reflect the information in control of each of the steering control unit, the engine control unit, and the power supply control unit.

In a structure in which the engine control unit and the power supply control unit communicate with the external control unit, the external control unit preferably includes a remote control unit including a semiconductor device and that is provided on a vessel body. Accordingly, the remote control unit, the engine control unit, and the power supply control unit transmit and receive information to and from each other and are able to reflect the information in control of each of the remote control unit, the engine control unit, and the power supply control unit.

In a structure in which the engine control unit and the power supply control unit communicate with the external control unit, the one of the engine control unit and the power supply control unit is preferably configured or programmed to acquire failure information of the other of the engine control unit and the power supply control unit via the communication cable. Accordingly, the one of the engine control unit and the power supply control unit is able to reflect the failure information of the other of the engine control unit and the power supply control unit in control of the one of the engine control unit and the power supply control unit. Consequently, occurrence of a control failure in the one of the engine control unit and the power supply control unit due to the failure information of the other of the engine control unit and the power supply control unit is significantly reduced or prevented.

A structure in which the engine control unit and the power supply control unit communicate with the external control unit preferably further includes a power generator that generates electricity due to a drive force of the engine and a rectification unit including a rectification controller including a semiconductor device and that is configured or programmed to perform control of rectifying the electricity generated by the power generator, and the communication cable preferably communicably connects the rectification unit, the engine control unit, and the power supply control unit to each other. Accordingly, the rectification unit, the engine control unit, and the power supply control unit transmit and receive information to and from each other and are able to reflect the information in control of each of the rectification unit, the engine control unit, and the power supply control unit.

In a structure in which the engine control unit and the power supply control unit communicate with the external control unit, the engine control unit and the power supply control unit are preferably communicably connected to each other by the communication cable based on a CAN communication standard. Accordingly, the other of the engine control unit and the power supply control unit acquires only necessary control information transmitted from the one of the engine control unit and the power supply control unit via the communication cable based on the CAN communication standard as appropriate.

An outboard motor according to a preferred embodiment of the present invention preferably further includes a driver disposed below the one of the engine control unit and the power supply control unit on the first side surface of the engine and that drives an electrical component of the engine. Accordingly, the one of the engine control unit and the power supply control unit is close to the other of the engine control unit and the power supply control unit mounted on the upper surface of the engine, and thus the length of the communication cable that connects the engine control unit to the power supply control unit is reduced. Consequently, interference of the communication cable with the members inside the cowling is significantly reduced or prevented as compared with the case where the communication cable is long.

An outboard motor according to a preferred embodiment of the present invention preferably further includes a starter mounted on a third side surface of the engine that faces the first side surface and that starts the engine. Accordingly, a larger mounting area for the one of the engine control unit and the power supply control unit is ensured on the first side surface as compared with the case where the starter is mounted on the first side surface on which the one of the engine control unit and the power supply control unit is mounted. Consequently, even when the one of the engine control unit and the power supply control unit is relatively large, the one of the engine control unit and the power supply control unit is easily mounted on the engine.

A marine vessel according to a preferred embodiment of the present invention includes a vessel body and an outboard motor mounted on the vessel body. The outboard motor includes an engine including a cylinder that reciprocates in a horizontal or substantially horizontal direction, a cowling that covers the engine, and a control unit separated into an engine control unit including a first controller including a semiconductor device, and a power supply control unit configured or programmed to communicate with the engine control unit and including a second controller including a semiconductor device, and one of the engine control unit and the power supply control unit is mounted on a first side surface of the engine, and the other of the engine control unit and the power supply control unit is mounted on an upper surface of the engine.

In a marine vessel according to a preferred embodiment of the present invention, the control unit is separated into the engine control unit and the power supply control unit in the outboard motor. Furthermore, the one of the engine control unit and the power supply control unit is mounted on the first side surface of the engine, and the other of the engine control unit and the power supply control unit is mounted on the upper surface of the engine. Accordingly, an increase in the size of the cowling of the outboard motor is significantly reduced or prevented similarly to the outboard motors according to preferred embodiments of the present invention described above. Consequently, the outboard motor (particularly a plurality of outboard motors) is easily mounted on the vessel body.

In a marine vessel according to a preferred embodiment of the present invention, the other of the engine control unit and the power supply control unit is mounted on the upper surface of the engine. Accordingly, maintenance of the outboard motor such as maintenance of the engine is easily performed similarly to the outboard motors according to preferred embodiments of the present invention described above.

A marine vessel according to a preferred embodiment of the present invention preferably further includes an external control unit provided outside the outboard motor and a communication cable that communicably connects the engine control unit to the power supply control unit and communicably connects the engine control unit, the power supply control unit, and the external control unit to each other. Accordingly, the engine control unit and the power supply control unit communicate not only with each other but also with the external control unit. Consequently, the external control unit, the engine control unit, and the power supply control unit transmit and receive information to and from each other and are able to reflect the information in control of each of the external control unit, the engine control unit, and the power supply control unit.

In a structure in which the engine control unit and the power supply control unit communicate with the external control unit, the external control unit preferably includes a steering control unit including a semiconductor device and that is configured or programmed to perform control of steering of an outboard motor body with respect to the vessel body. Accordingly, the steering control unit, the engine control unit, and the power supply control unit transmit and receive information to and from each other and are able to reflect the information in control of each of the steering control unit, the engine control unit, and the power supply control unit.

In a structure in which the engine control unit and the power supply control unit communicate with the external control unit, the external control unit preferably includes a remote control unit including a semiconductor device and that is provided on the vessel body. Accordingly, the remote control unit, the engine control unit, and the power supply control unit transmit and receive information to and from each other and are able to reflect the information in control of each of the remote control unit, the engine control unit, and the power supply control unit.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including an outboard motor 1 according to preferred embodiments of the present invention is now described with reference to FIGS. 1 and 2. In the figures, arrow FWD represents the forward movement direction of the marine vessel 100, and arrow BWD represents the reverse movement direction of the marine vessel 100. In the figures, arrow R represents the starboard direction of the marine vessel 100, and arrow L represents the portside direction of the marine vessel 100. In addition, a right-left direction (horizontal direction) is perpendicular to an upward-downward direction (direction Z).

Figure 1:
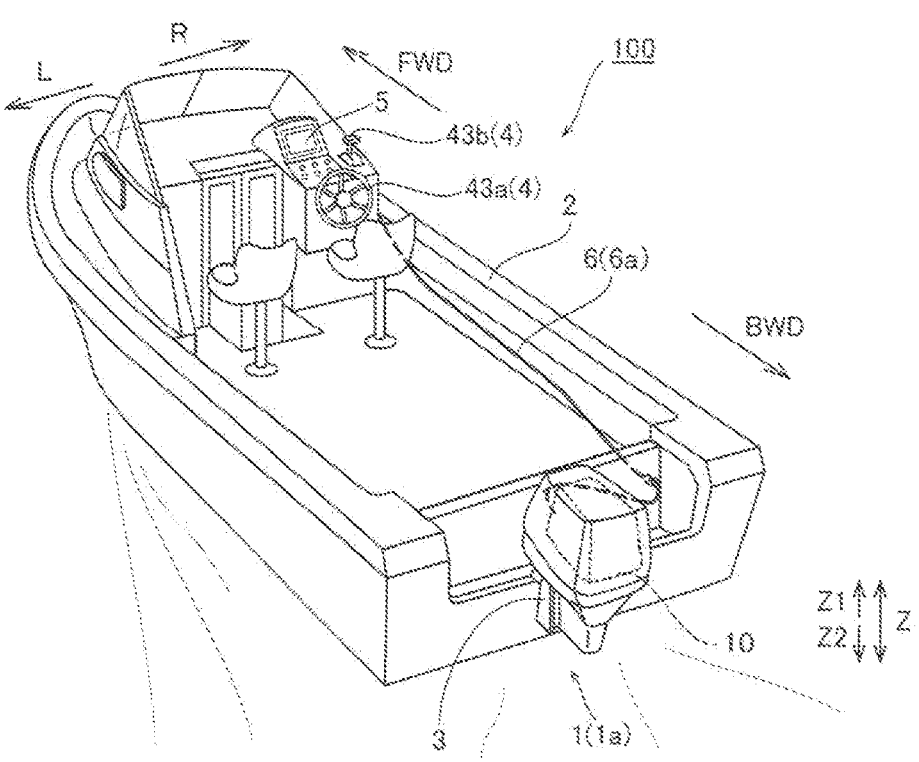
FIG. 1 is a perspective view schematically showing a marine vessel including an outboard motor according to a preferred embodiment of the present invention.
Figure 2:
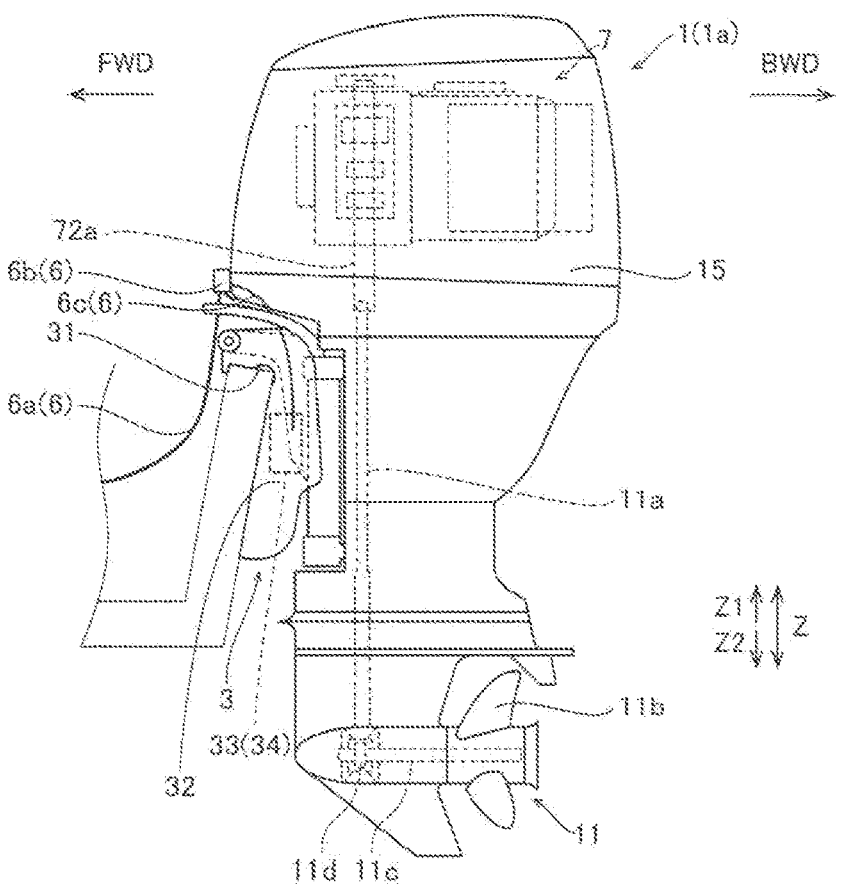
FIG. 2 is a diagram schematically showing an outboard motor according to a preferred embodiment of the present invention.

As shown in FIGS. 1 and 2, the marine vessel 100 includes the outboard motor 1, a vessel body 2 including a rear portion (BWD side) on which the outboard motor 1 is mounted, and a mounting bracket 3 that mounts the outboard motor 1 on the vessel body 2. As shown in FIG. 1, the marine vessel 100 further includes a remote control unit 4 provided on the vessel body 2 and operated (used to operate the marine vessel 100) by a vessel operator and a display 5. The remote control unit 4 is an example of an "external control unit".

In the marine vessel 100, as shown in FIGS. 1 and 2, the outboard motor 1, the mounting bracket 3, and the remote control unit 4 are communicably connected to each other by a CAN cable 6 based on the CAN communication standard, for example. The CAN communication standard is a communication standard standardized by ISO 11898. The CAN cable 6 includes a CAN main cable 6*a*, a plurality of CAN branch terminals (hubs) 6*b*, and a plurality of CAN sub cables 6*c* connected to the CAN main cable 6*a* at the CAN branch terminals 6*b*. The CAN cable 6 preferably is a portion of an electric cable of a wire harness and is preferably not an independent cable. In the figures, the CAN cable 6 is illustrated as being an independent cable, for example. The CAN cable 6 is an example of a "communication cable".

As shown in FIG. 2, the mounting bracket 3 includes a clamp bracket 31 and a bracket body 32. The clamp bracket 31 is fixed to the stern of the vessel body 2.

Figure 3:
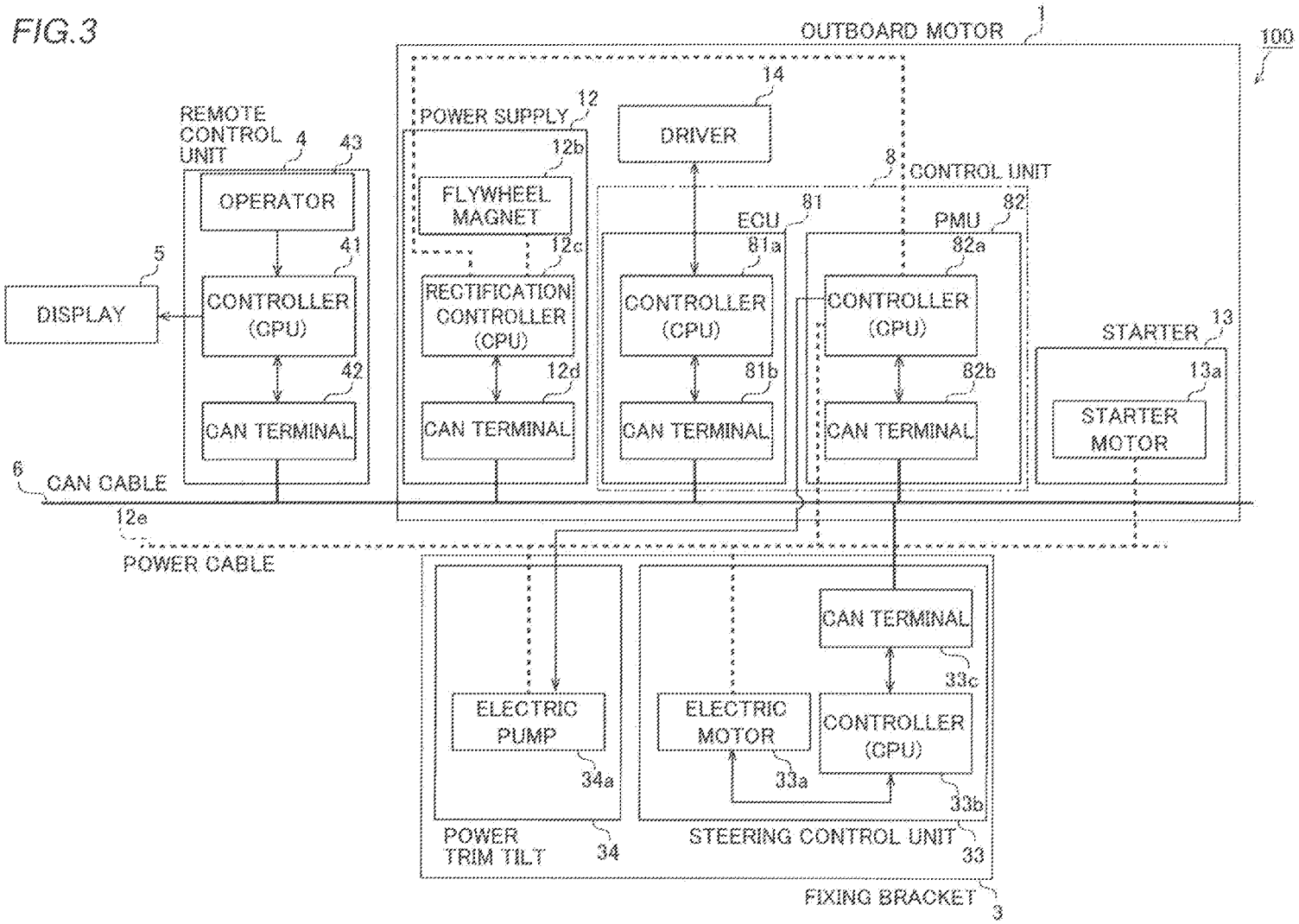
FIG. 3 is a block diagram of a marine vessel including an outboard motor according to a preferred embodiment of the present invention.

As shown in FIG. 3, the bracket body 32 includes a steering control unit 33 and a power trim tilt 34. The steering control unit 33 performs a function of rotating the outboard motor 1 (outboard motor body 1*a*) about an axis in the upward-downward direction. The power trim tilt 34 performs a function of rotating the outboard motor 1 (outboard motor body 1*a*) about an axis in the horizontal direction (right-left direction).

The steering control unit 33 includes an electric motor 33*a*, a controller 33*b* including a CPU including a semiconductor device, for example, that controls the driving of the electric motor 33*a*, and a CAN terminal 33*c* that connects the controller 33*b* to one of the CAN sub cables 6*c* of the CAN cable 6. The electric motor 33*a* rotates the outboard motor 1 about the axis in the upward-downward direction. The steering control unit 33 is an example of an "external control unit".

The controller 33*b* is configured or programmed to acquire steering control information transmitted from an ECU 81, described below, from the CAN cable 6 via the CAN terminal 33*c*. The controller 33*b* is configured or programmed to drive the electric motor 33*a* based on the steering control information.

The power trim tilt 34 includes an electric pump 34*a*. The electric pump 34*a* adjusts the amount of oil supplied to an oil bumper (not shown) to lift (tilt up) the outboard motor 1 (outboard motor body 1*a*) or lower (tilt down) the outboard motor 1. At this time, the electric pump 34*a* requires a large current to supply the oil to the oil bumper.

The remote control unit 4 is used by the vessel operator to operate the marine vessel 100. The remote control unit 4 includes a controller 41 including a CPU including a semiconductor device, for example, a CAN terminal 42 that connects the controller 41 to the CAN cable 6, and an operator 43 that receives an operation from the vessel operator. The operator 43 includes a steering wheel 43*a* used by the vessel operator to steer the vessel body 2 (turn the outboard motor 1) and a lever 43*b* used by the vessel operator to manipulate the shift and output (throttle opening degree) of the outboard motor 1.

The controller 41 is configured or programmed to transmit an operation performed on the operator 43 by the vessel operator as operation control information to the CAN cable 6 via the CAN terminal 42. The controller 41 is configured or programmed to acquire, from the CAN cable 6 via the CAN terminal 42, display control information transmitted from the ECU 81. The controller 41 is configured or programmed to control the display 5 based on the display control information.

Figure 4:
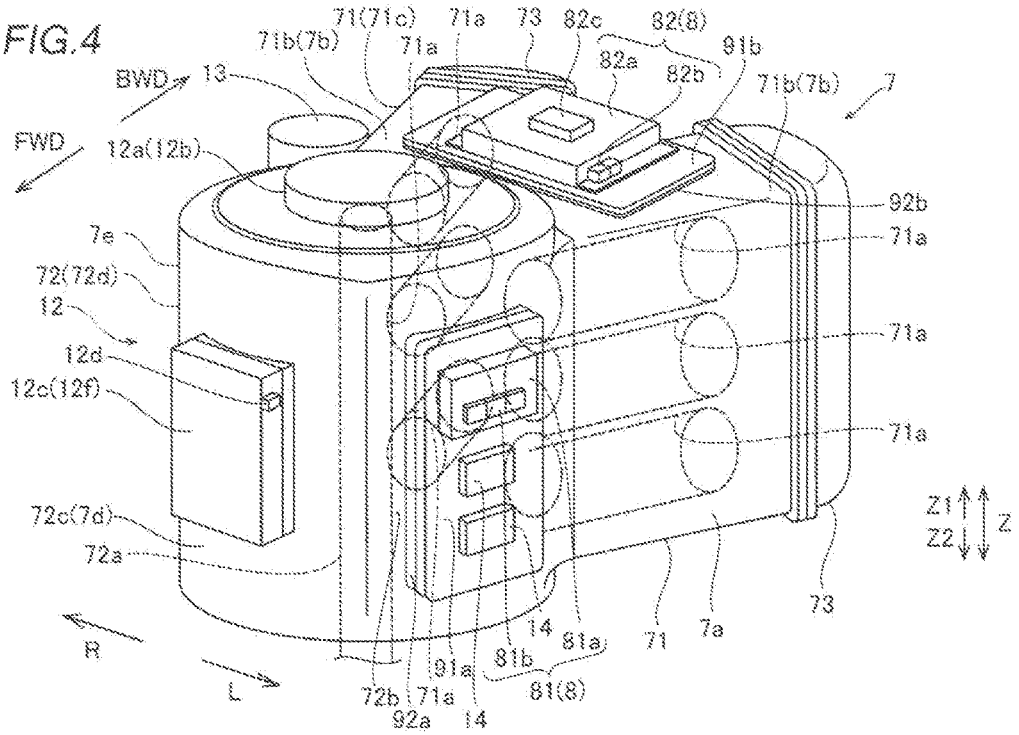
FIG. 4 is a perspective view showing an engine of an outboard motor according to a preferred embodiment of the present invention.

As shown in FIG. 2, the outboard motor 1 includes an engine 7 and a propulsion unit 11. As shown in FIGS. 3 and 4, the outboard motor 1 includes a control unit 8 configured or programmed to control the marine vessel 100, a power supply 12, a starter 13, and two drivers 14, for example. The outboard motor 1 includes a cowling 15 in which the engine 7 is housed. Hereinafter, a side of the outboard motor 1 mounted on the vessel body 2 is defined as a front side (FWD), and the opposite side is defined as a back side (BWD) at the steering position of the outboard motor 1 when the marine vessel 100 moves in the forward movement direction or the reverse movement direction. In addition, a direction perpendicular to a front-back direction of the outboard motor 1 in a horizontal plane is defined as a right-left direction of the outboard motor 1.

As shown in FIG. 4, the engine 7 preferably includes six cylinders 71*a*, for example. In the six cylinders 71*a*, pistons (not shown) reciprocate in the horizontal or substantially horizontal direction. The engine 7 is a V-type or V-shaped engine, for example, in which the six cylinders 71*a* are disposed in a V-shape. Specifically, in the engine 7, a pair of cylinder groups each including three cylinders 71*a* are disposed in a pair of cylinder blocks 71, respectively. The pair of cylinder blocks 71 diverge in a V-shape from a crankcase 72. The three cylinders 71*a* are aligned in the upward-downward direction in each of the cylinder blocks 71. Portions of the pair of cylinder blocks 71 opposite to the crankcase 72 are covered with a pair of cylinder heads 73, respectively. The cylinder blocks 71 each may be separated into a cylinder block body and a cylinder head.

A crankshaft 72*a* that extends in the upward-downward direction is inserted into the crankcase 72. The crankshaft 72*a* is rotated due to a drive force of the pistons (not shown) that slide in the cylinders 71*a*. A flywheel 12*a*, described below, of the power supply 12 is mounted on an end (upper end) of the crankshaft 72*a* on a Z1 side. In other words, the flywheel 12*a* is located above the engine 7. An end (lower end) of the crankshaft 72*a* on a Z2 side is connected to a drive shaft 11*a* (see FIG. 2), described below, of the propulsion unit 11.

Figure 6:
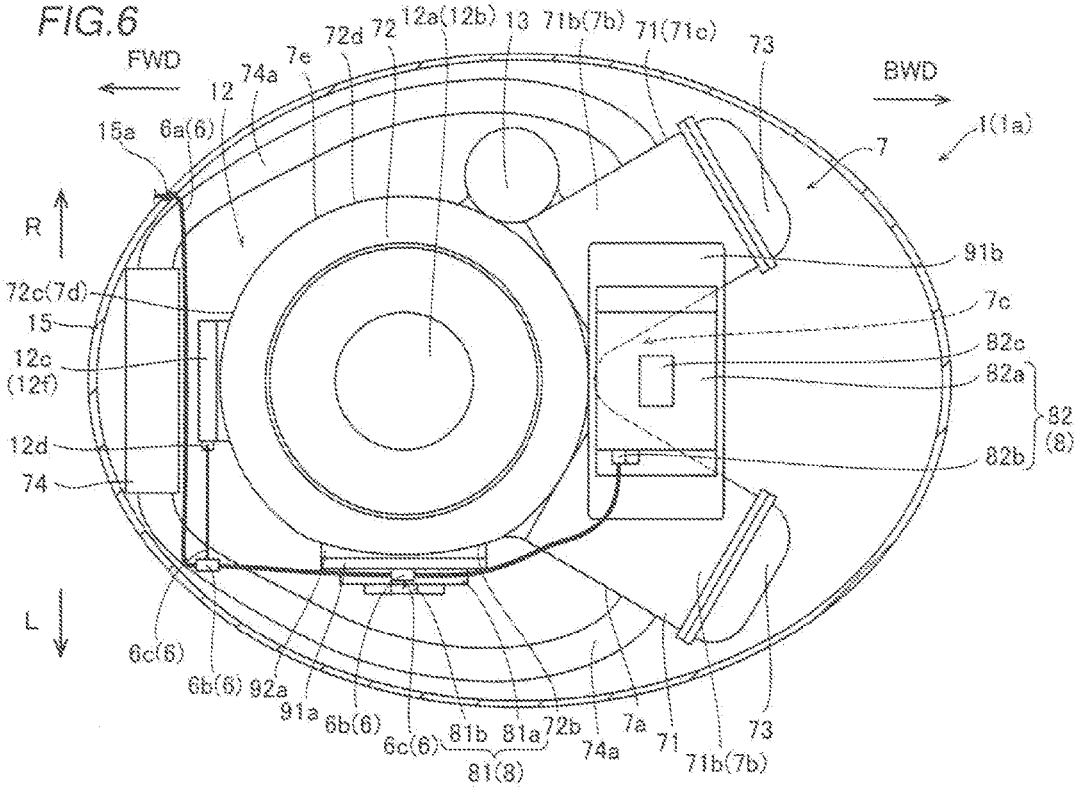
FIG. 6 is a plan view showing the periphery of an engine of an outboard motor according to a preferred embodiment of the present invention.

The cylinder blocks 71 are connected to a plurality of intake pipes 74*a* of an intake 74 through which intake air is supplied to the respective cylinders 71*a*. The cylinder blocks 71 are connected to a plurality of exhaust pipes of an exhaust (not shown) through which exhaust air is discharged from the respective cylinders 71*a*. As shown in FIG. 6, the intake pipes 74*a* are disposed between the engine 7 and the cowling in the horizontal direction (right-left direction). The intake pipes 74*a* extend in a front-back direction while being routed in a left direction (L) or a right direction (R) so as to be spaced away from the left side surface 7*a* or the right side surface 7*e* of the engine 7.

As shown in FIG. 2, the propulsion unit 11 converts a rotational drive force of the engine 7 into a thrust force of the marine vessel 100. The propulsion unit 11 includes the drive shaft 11*a* connected to the engine 7, a propeller 11*b*, a propeller shaft 11*c* connected to the drive shaft 11*a* and the propeller 11*b*, and a switch 11*d* that switches the direction of the thrust force by switching the rotational direction of the propeller 11*b*. The switch 11*d* switches the direction of the thrust force based on an instruction from the control unit 8.

As shown in FIG. 3, the control unit 8 includes the ECU (engine control unit) 81 configured or programmed to primarily perform overall control of the operation etc. of the marine vessel 100 such as the engine 7 and the propulsion unit 11 and a power management unit (PMU) 82 configured or programmed to primarily perform overall control of the power supply of the outboard motor 1 and the mounting bracket 3. The ECU 81 and the power management unit 82 are examples of an "engine control unit" and a "power supply control unit", respectively.

The ECU 81 includes a controller 81*a* including a CPU including a semiconductor device, for example, and a CAN terminal 81*b* that connects the controller 81*a* to one of the CAN sub cables 6*c* of the CAN cable 6. The controller 81*a* is an example of a "first controller".

The controller 81*a* is configured or programmed to transmit control information of the operation etc. of the marine vessel 100 to the CAN cable 6 via the CAN terminal 81*b*. The controller 81*a* is configured or programmed to transmit steering control information, tilt control information, and display control information to the CAN cable 6. The controller 81*a* is configured or programmed to acquire, from the CAN cable 6 via the CAN terminal 81*b*, control information of operations transmitted from the remote control unit 4, for example.

The power management unit 82 includes a controller 82*a* including a CPU including a semiconductor device, for example, and a CAN terminal 82*b* that connects the controller 82*a* to the CAN cable 6. The controller 82*a* is an example of a "second controller".

The controller 82*a* is configured or programmed to transmit power supply control information, for example, to the CAN cable 6 via the CAN terminal 82*b*. Furthermore, the controller 82*a* is configured or programmed to directly control the amount of current supplied to the electric pump 34*a* of the power trim tilt 34. Consequently, the power management unit 82 is configured or programmed to adjust the amount of current supplied to the power trim tilt 34 (electric pump 34*a*). Accordingly, when a sufficient amount of current may not be supplied to another electrical device, the power management unit 82 reduces the amount of current supplied to the power trim tilt 34 that requires a large amount of current, and thus failure to correctly drive another electrical device due to the tilt operation is significantly reduced or prevented.

The ECU 81 and the power management unit 82 are configured or programmed to transmit and receive control information to and from each other via the CAN cable 6. Therefore, the ECU 81 and the power management unit 82 function as one control unit 8 even in a separated state.

The ECU 81 and the power management unit 82 are configured or programmed to communicate with the external control units (for example, the remote control unit 4 and the steering control unit 33) provided outside the outboard motor body 1*a*.

The ECU 81 is configured or programmed to acquire failure information of the power management unit 82 from the CAN cable 6 via the CAN terminal 81*b*. Similarly, the power management unit 82 is configured or programmed to acquire failure information of the ECU 81 from the CAN cable 6 via the CAN terminal 82*b*. The ECU 81 and the power management unit 82 are also configured or programmed to acquire failure information of a rectification unit 12*f*, described below, and the external control units (for example, the remote control unit 4 and the steering control unit 33) from the CAN cable 6.

Figure 5:
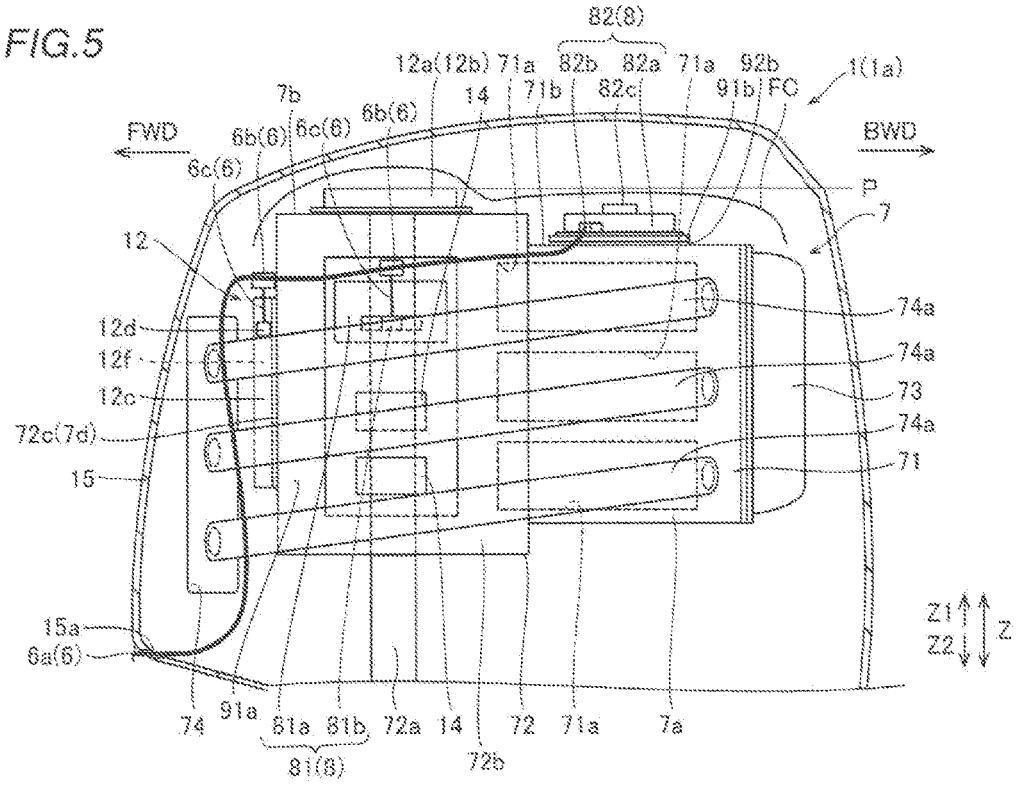
FIG. 5 is a side elevational view showing the periphery of an engine of an outboard motor according to a preferred embodiment of the present invention.

According to a preferred embodiment, the ECU 81 is mounted on the left side surface 7*a*, which is a side surface of the engine 7 on an L side, as shown in FIGS. 4 to 6. Specifically, the ECU 81 is mounted on the left side surface 72*b* of the crankcase 72 of the engine 7. The ECU 81 is mounted on a resin bracket 91*a* preferably having a rectangular or substantially rectangular shape elongated in the upward-downward direction. The bracket 91*a* is screwed to the left side surface 72*b* such that a rubber vibration isolator 92*a* that significantly reduces or prevents transmission of vibrations of the engine 7 to the bracket 91*a* is held therebetween. Consequently, the ECU 81 is fixed to the left side surface 72*b* via the bracket 91*a* and the rubber vibration isolator 92*a*. The ECU 81 is fixed to the bracket 91*a* above the centers of the bracket 91*a* and the crankcase 72 in the upward-downward direction. The bracket 91*a* and the rubber vibration isolator 92*a* significantly reduce or prevent direct transmission of heat of the engine 7 to the ECU 81. The left side surface 7*a* is an example of a "first side surface".

According to a preferred embodiment, the power management unit 82 is mounted on the upper surface 7*b* of the engine 7. Specifically, the power management unit 82 is mounted on both the upper surfaces 71*b* of the pair of cylinder blocks 71 of the engine 7. As shown in FIG. 6, the power management unit 82 is mounted on the upper surface 7*b* of the engine 7 so as to extend over a portion 7*c* of the engine 7 that diverges in a V-shape in a planar view. The power management unit 82 is mounted on the upper surface 7*b* directly above (corresponding positions) the cylinders 71*a* of the engine 7.

The power management unit 82 is mounted on, for example, a rectangular or substantially rectangular resin bracket 91*b*. The bracket 91*b* is screwed to both a pair of upper surfaces 71*b* such that a rubber vibration isolator 92*b* (see FIGS. 4 and 5) is held therebetween. Consequently, the power management unit 82 is fixed to the pair of upper surfaces 71*b* via the bracket 91*b* and the rubber vibration isolator 92*b*. The bracket 91*b* and the rubber vibration isolator 92*b* significantly reduce or prevent direct transmission of the heat of the engine 7 to the power management unit 82.

As shown in FIG. 5, the upper end 82*c* of the power management unit 82 is located below (Z2 side) the upper end (height position P) of the flywheel 12*a*. Thus, interference of the upper end of the power management unit 82 with a flywheel cover FC disposed above the flywheel 12*a* (above the engine 7) and covering the flywheel 12*a* is significantly reduced or prevented. In FIG. 5, the flywheel cover FC is schematically shown.

The left side surface 7*a* of the engine 7 on which the ECU 81 is mounted is located at a position where air flow caused by air intake is likely to occur. Therefore, even when the ECU 81 generates heat due to control processing of the ECU 81, the ECU 81 is cooled by the air flow. On the other hand, at the upper surface 7*b* of the engine 7 on which the power management unit 82 is mounted, air flow caused by air intake is unlikely to occur, and heat is likely to accumulate. However, the power management unit 82 is driven for a shorter period of time than the ECU 81 such that the power management unit 82 is unlikely to generate heat, and thus thermal failure is unlikely to occur.

As shown in FIG. 3, the power supply 12 generates electricity due to the drive force of the engine 7 and supplies the generated electricity to electrical components of the outboard motor 1 and the mounting bracket 3 via a power cable 12*e*. The electrical components of the outboard motor 1 and the mounting bracket 3 include the drivers 14, the electric motor 33*a*, the electric pump 34*a*, etc. In the figures other than FIG. 3, illustration of the power cable 12*e* is omitted. The power cable 12*e* is also connected to the starter 13 that starts the engine 7.

The power supply 12 includes the flywheel 12*a* that is rotated by the drive force of the engine 7 via the crankshaft 72*a*, a flywheel magnet 12*b* that generates electricity using the rotation of the flywheel 12*a*, and a rectification controller 12*c* configured or programmed to rectify the electricity generated by the flywheel magnet 12*b*, and a CAN terminal 12*d* that connects the rectification controller 12*c* to the CAN cable 6. The rectification unit 12*f* includes the rectification controller 12*c* and the CAN terminal 12*d*. Consequently, the rectification unit 12*f* is communicably connected to the ECU 81 and the power management unit 82 via the CAN cable 6. The flywheel magnet 12*b* is an example of a "power generator".

As shown in FIGS. 4 to 6, the rectification unit 12*f* is mounted on the front side surface 7*d* of the engine 7. Specifically, the rectification unit 12*f* is mounted on the front side surface 72*c* of the crankcase 72 of the engine 7. The front side surface 7*d* is an example of a "second side surface".

As shown in FIG. 3, the starter 13 starts the engine 7. The starter 13 includes a starter motor 13*a* to which power is supplied from a battery (not shown) via the power cable 12*e* at the time of starting.

As shown in FIGS. 4 and 6, the starter 13 is mounted on the right side surface 7*e* of the engine 7, which faces the left side surface 7*a* and is a side surface on an R side. Specifically, the starter 13 is mounted over the right side surface 71*c* of a cylinder block 71 of the engine 7 and the right side surface 72*d* of the crankcase 72. The right side surface 7*e* is an example of a "third side surface".

As shown in FIG. 3, the two drivers 14 drive electrical components (not shown) (such as injectors provided in the cylinders 71*a*, respectively) of the engine 7 based on instructions from the ECU 81.

As shown in FIGS. 4 and 5, the two drivers 14 are aligned in the upward-downward direction on the bracket 91*a* fixed to the left side surface 7*a* of the engine 7. That is, both of the two drivers 14 are mounted on the same bracket 91*a* on which the ECU 81 is mounted. The two drivers 14 are fixed to the bracket 91*a* (the left side surface 7*a* of the engine 7) below the ECU 81.

As shown in FIGS. 5 and 6, a hole 15*a* through which the CAN cable 6 (CAN main cable 6*a*) inside the cowling 15 is led to the outside of the cowling 15 (the outside of the outboard motor 1) is provided on the cowling 15.

According to the various preferred embodiments of the present invention described above, the following advantageous effects are achieved.

According to a preferred embodiment of the present invention, the control unit 8 is separated into the ECU 81 and the power management unit 82. Furthermore, the ECU 81 is mounted on the left side surface 7*a* of the engine 7, and the power management unit 82 is mounted on the upper surface 7*b* of the engine 7. Accordingly, only the ECU 81, which is an element of the control unit 8, is disposed on the left side surface 7*a* of the engine 7, and thus interference of the cowling 15 and members (intake pipes 74*a*, for example) inside the cowling 15 with the control unit 8 in the vicinity of the left side surface 7*a* of the engine 7 is significantly reduced or prevented. Furthermore, the control unit 8 is separated into the ECU 81 and the power management unit 82 such that the separated components (the ECU 81 and the power management unit 82) of the control unit 8 are each located in a relatively small empty space between the engine 7 and the cowling 15 or the members inside the cowling 15 and are mounted on the engine 7 as compared with the case where the ECU 81 and the power management unit 82 are integral and unitary with each other. Consequently, an increase in the size of the cowling 15 is significantly reduced or prevented.

According to a preferred embodiment of the present invention, the power management unit 82 is mounted on the upper surface 7*b* of the engine 7. Accordingly, unlike the case where the power management unit 82 is mounted on the inner surface of an upper portion of the flywheel cover FC, the flywheel cover FC is detached to expose the engine 7 without detaching the wire harness including the CAN cable 6 connected to the power management unit 82 defining an electric cable, for example. Consequently, maintenance of the outboard motor 1 such as maintenance of the engine 7 is easily performed.

According to a preferred embodiment of the present invention, the power management unit 82 is mounted at a location on the upper surface 7*b* of the engine 7 that corresponds to the cylinders 71*a* of the engine 7. Accordingly, the power management unit 82 is mounted at a relatively flat location that corresponds to the cylinders 71*a* of the engine 7 such that the power management unit 82 is securely mounted on the engine 7.

According to a preferred embodiment of the present invention, the power management unit 82 is mounted on the upper surface 7*b* of the engine 7 via the rubber vibration isolator 92*b* and the bracket 91*b*. Accordingly, the rubber vibration isolator 92*b* significantly reduces or prevents direct transmission of vibrations of the cylinders 71*a* to the power management unit 82, and thus the power management unit 82 including a semiconductor device, for example, having a relatively low resistance to vibration is protected. In addition, the power management unit 82 is securely mounted on the engine 7 via the rubber vibration isolator 92*b* and the bracket 91*b* regardless of the shape of the engine 7.

According to a preferred embodiment of the present invention, the power management unit 82 is disposed on the upper surface 7*b* of the V-type or V-shaped engine 7 so as to extend over the portion 7*c* of the V-type or V-shaped engine 7 that diverges in a V-shape in a planar view. Accordingly, the diverging portion 7*c* of the V-type or V-shaped engine 7 is used to ensure a large mounting area for the power management unit 82, and thus the power management unit 82 is easily mounted on the engine 7 even when the power management unit 82 is relatively large.

According to a preferred embodiment of the present invention, the upper end 82*c* of the power management unit 82 is disposed below the upper end (height position P) of the flywheel 12*a*. Accordingly, upward protrusion of the power management unit 82 from the flywheel 12*a* is significantly reduced or prevented, and thus increases in the sizes of the cowling 15 and the outboard motor 1 in the upward-downward direction are significantly reduced or prevented.

According to a preferred embodiment of the present invention, the rectification unit 12*f* is mounted on the front side surface 7*d* different from the left side surface 7*a* on which the ECU 81 is mounted. Accordingly, a mounting area for the ECU 81 is ensured on the left side surface 7*a* as compared with the case where the rectification unit 12*f* is mounted on the left side surface 7*a* on which the ECU 81 is mounted. In addition, as compared with the case where the rectification unit 12*f* is mounted on the upper surface 7*b* on which the power management unit 82 is mounted, a larger mounting area for the power management unit 82 is ensured on the upper surface 7*b*. Consequently, even when the control unit 8 is separated into the ECU 81 and the power management unit 82, the ECU 81 and the power management unit 82 are easily mounted on the engine 7.

According to a preferred embodiment of the present invention, the ECU 81 and the power management unit 82 are configured or programmed to communicate with the external control units (for example, the remote control unit 4 and the steering control unit 33) provided outside the outboard motor body 1*a* via the CAN cable 6. Accordingly, the ECU 81 and the power management unit 82 communicate not only with each other but also with the external control units. Consequently, the external control units, the ECU 81, and the power management unit 82 transmit and receive information to and from each other and are able to reflect the information in control of each of the external control units, the ECU 81, and the power management unit 82. Furthermore, the control information is distributed to the ECU 81 and the power management unit 82, and thus the load on the ECU 81 and the power management unit 82 is reduced, and the control processing time is reduced to improve the responsiveness as compared with the case where the control information from the external control units is concentrated only in one control unit.

According to a preferred embodiment of the present invention, the external control unit includes the steering control unit 33 that includes a semiconductor device, for example, and performs steering control of the outboard motor body 1*a* with respect to the vessel body 2. Accordingly, the steering control unit 33, the ECU 81, and the power management unit 82 transmit and receive information to and from each other and are able to reflect the information in control of each of the steering control unit 33, the ECU 81, and the power management unit 82.

According to a preferred embodiment of the present invention, the external control unit includes the remote control unit 4 including a semiconductor device, for example, and is provided on the vessel body. Accordingly, the remote control unit 4, the ECU 81, and the power management unit 82 transmit and receive information to and from each other and are able to reflect the information in control of each of the remote control unit 4, the ECU 81, and the power management unit 82.

According to a preferred embodiment of the present invention, the ECU 81 and the power management unit 82 are configured or programmed to acquire the failure information of the power management unit 82 and the ECU 81 from each other via the CAN cable 6. Accordingly, the ECU 81 is able to reflect the failure information of the power management unit 82 in control of the ECU 81. Furthermore, the power management unit 82 is able to reflect the failure information of the ECU 81 in control of the power management unit 82. Consequently, occurrence of a failure in control of one of the ECU 81 and the power management unit 82 due to the failure information of the other of the ECU 81 and the power management unit 82 is significantly reduced or prevented.

According to a preferred embodiment of the present invention, the CAN cable 6 communicably connects the rectification unit 12*f*, the ECU 81, and the power management unit 82 to each other. Accordingly, the rectification unit 12*f*, the ECU 81, and the power management unit 82 transmit and receive information to and from each other and are able to reflect the information in control of each of the rectification unit 12*f*, the ECU 81, and the power management unit 82.

According to a preferred embodiment of the present invention, the ECU 81 and the power management unit 82 are communicably connected to each other by the CAN cable 6 based on the CAN communication standard. Accordingly, one of the ECU 81 and the power management unit 82 acquires only necessary control information transmitted from the other of the ECU 81 and the power management unit 82 via the CAN cable 6 based on the CAN communication standard as appropriate.

According to a preferred embodiment of the present invention, the drivers 14 that drive the electrical components of the engine 7 are disposed below the ECU 81 on the left side surface 7*a* of the engine 7. Accordingly, the ECU 81 is close to the power management unit 82 mounted on the upper surface 7*b* of the engine 7, and thus the length of the CAN cable 6 that connects the ECU 81 to the power management unit 82 is reduced. Consequently, interference of the CAN cable 6 with the members inside the cowling 15 is significantly reduced or prevented as compared with the case where the CAN cable 6 is long.

According to a preferred embodiment of the present invention, the starter 13 that starts the engine 7 is mounted on the right side surface 7*e* of the engine 7 that faces the left side surface 7*a*. Accordingly, a larger mounting area for the ECU 81 is ensured on the left side surface 7*a* as compared with the case where the starter 13 is mounted on the left side surface 7*a* on which the ECU 81 is mounted. Consequently, even when the ECU 81 is relatively large, the ECU 81 is easily mounted on the engine 7.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

Figure 7:
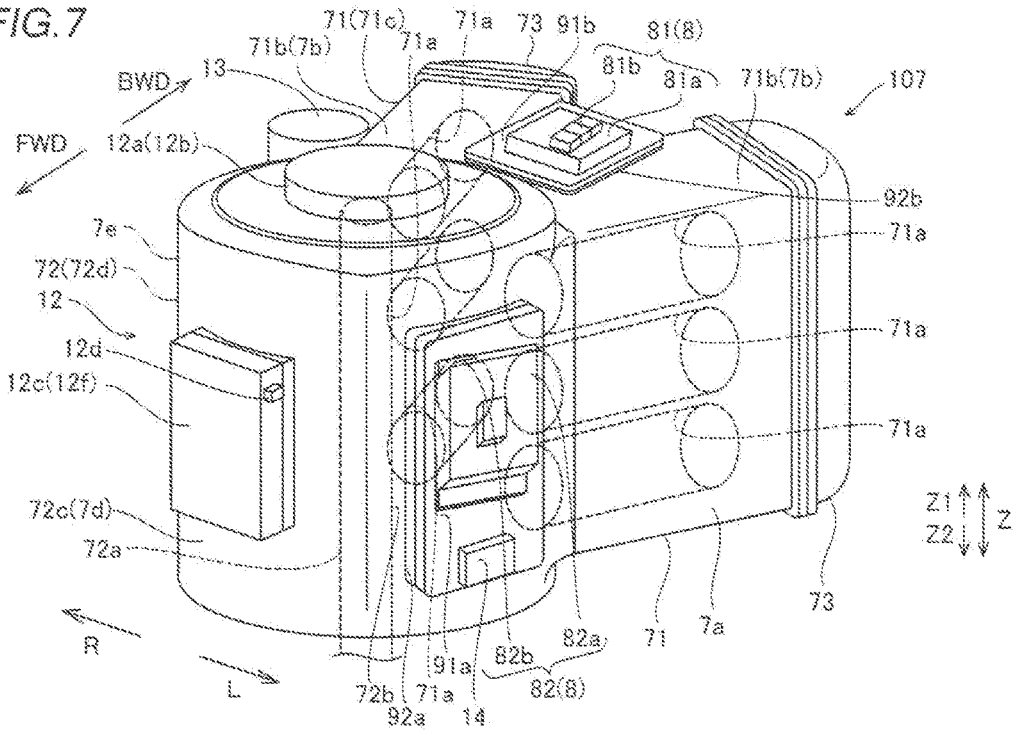
FIG. 7 is a perspective view showing an engine of an outboard motor according to a modified preferred embodiment of the present invention.

For example, while the ECU 81 (engine control unit) is preferably mounted on the left side surface 7*a* (first side surface) of the engine 7, and the power management unit 82 (power supply control unit) is preferably mounted on the upper surface 7*b* of the engine 7 in preferred embodiments described above, the present invention is not restricted to this. As in an engine 107 according to a modified preferred embodiment shown in FIG. 7, an ECU 81 (engine control unit) may alternatively be mounted on the upper surface 7*b* of the engine 107, and a power management unit 82 (power supply control unit) may alternatively be mounted on the left side surface 7*a* (first side surface) of the engine 107.

While preferred embodiments of the present invention are preferably applied to the marine vessel 100 including the vessel body 2 on which one outboard motor 1 is mounted in preferred embodiments described above, the present invention is not restricted to this. Preferred embodiments of the present invention may alternatively be applied to a marine vessel including a vessel body on which a plurality of outboard motors are mounted. In this case, according to preferred embodiments of the present invention, an increase in the size of a cowling is significantly reduced or prevented, and thus the plurality of outboard motors are easily mounted on the vessel body. Thus, the plurality of outboard motors are easily mounted on the vessel body of the marine vessel.

In this case, the plurality of outboard motors are able to be communicably connected to each other by a CAN cable (communication cable).

While the ECU 81 (the one of the engine control unit and the power supply control unit) is preferably mounted on the left side surface 7*a* (first side surface) of the engine 7 in preferred embodiments described above, the present invention is not restricted to this. One of the engine control unit and the power supply control unit may alternatively be disposed on any one of the side surfaces (the front side surface, the right side surface, and the rear side surface) of the engine other than the left side surface.

While the ECU 81 (the one of the engine control unit and the power supply control unit) is preferably mounted on the left side surface 7*a* (first side surface) of the engine 7 via the bracket 91*a*, and the power management unit 82 (the other of the engine control unit and the power supply control unit) is preferably mounted on the upper surface 7*b* of the engine 7 via the bracket 91*b* in preferred embodiments described above, the present invention is not restricted to this. The engine control unit and the power supply control unit may alternatively be mounted directly on the engine. In this case, a metal core substrate in which metal is embedded is preferably used as a substrate including the engine control unit and the power supply control unit to efficiently dissipate heat generated in the engine control unit and the power supply control unit and heat from the engine.

While the power management unit 82 (the other of the engine control unit and the power supply control unit) is preferably mounted on the upper surfaces 71*b* of the pair of cylinder blocks 71 of the engine 7 so as to extend over the portion 7*c* of the V-type or V-shaped engine 7 that diverges in a V-shape in a planar view in preferred embodiments described above, the present invention is not restricted to this. For example, the other of the engine control unit and the power supply control unit may alternatively be mounted only on the upper surface of one of the pair of the cylinder blocks.

While preferred embodiments of the present invention are preferably applied to the V-type or V-shaped engine 7 in preferred embodiments described above, the present invention is not restricted to this. Preferred embodiments of the present invention may alternatively be applied to a so-called in-line engine or horizontally opposed engine.

While the control unit 8 is preferably separated into the ECU 81 (engine control unit) and the power management unit 82 (power supply control unit) in preferred embodiments described above, the present invention is not restricted to this. One of the engine control unit and the power supply control unit may alternatively be further divided and be disposed on the first side surface of the engine, or the other of the engine control unit and the power supply control unit may alternatively be further divided and be disposed on the upper surface of the engine.

While a plurality of control units ((the ECU 81, engine control unit), the power management unit 82 (power supply control unit), the rectification unit 12*f*, and the external control units (for example, the remote control unit 4 and the steering control unit 33)) are preferably connected to each other by the CAN cable 6 based on the CAN communication standard in preferred embodiment described above, the present invention is not restricted to this. The plurality of control units may alternatively be connected to each other by a communication cable based on a standard other than the CAN communication standard.

While the drivers 14 are preferably fixed to the same bracket 91*a* to which the ECU 81 (the one of the engine control unit and the power supply control unit) is fixed in preferred embodiments described above, the present invention is not restricted to this. The drivers may alternatively be fixed to the same bracket to which the other of the engine control unit and the power supply control unit is fixed, or may alternatively be fixed to a separate bracket from the bracket to which the engine control unit or the power supply control unit is fixed. Furthermore, the drivers may alternatively be mounted directly on the engine.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a cylinder that reciprocates in a horizontal or substantially horizontal direction;

a cowling that covers the engine;

a control unit including an engine control unit and a power supply control unit; and a communication cable that communicably connects the engine control unit to the power supply control unit; wherein the engine control unit includes a first controller;

the power supply control unit is configured or programmed to communicate with the engine control unit and includes a second controller;

one of the engine control unit and the power supply control unit is mounted on a first side surface of the engine, and the other of the engine control unit and the power supply control unit is mounted on an upper surface of the engine;

the engine control unit and the power supply control unit are configured or programmed to communicate with an external control unit via the communication cable; and the external control unit is arranged on a mounting bracket that fixes the outboard motor to a vessel body.

2. The outboard motor according to claim 1, wherein the other of the engine control unit and the power supply control unit is mounted at a location on the upper surface of the engine that corresponds to the cylinder of the engine.

3. The outboard motor according to claim 1, wherein the other of the engine control unit and the power supply control unit is mounted on the upper surface of the engine via a rubber vibration isolator and a bracket.

4. The outboard motor according to claim 1, wherein the engine is a V-shaped engine; and the other of the engine control unit and the power supply control unit is disposed on the upper surface of the V-shaped engine so as to extend over a portion of the V-shaped engine that diverges in a V-shape in a planar view.

5. The outboard motor according to claim 1, further comprising a power generator disposed above the engine and that generates electricity due to a drive force of the engine; wherein an upper end of the other of the engine control unit and the power supply control unit is located below an upper end of the power generator.

6. The outboard motor according to claim 1, further comprising a power generator that generates electricity due to a drive force of the engine; and a rectification unit including a rectification controller configured or programmed to control rectifying the electricity generated by the power generator; wherein the rectification unit is mounted on a second side surface different from the first side surface on which the one of the engine control unit and the power supply control unit is mounted.

7. The outboard motor according to claim 1, wherein the external control unit includes a steering controller configured or programmed to control steering of the outboard motor body with respect to a vessel body.

8. The outboard motor according to claim 1, wherein the external control unit includes a remote control provided on a vessel body.

9. The outboard motor according to claim 1, wherein the one of the engine control unit and the power supply control unit is configured or programmed to acquire failure information of the other of the engine control unit and the power supply control unit via the communication cable.

10. The outboard motor according to claim 1, further comprising a power generator that generates electricity due to a drive force of the engine; and a rectification unit including a rectification controller configured or programmed to control rectifying the electricity generated by the power generator; wherein the communication cable communicably connects the rectification unit, the engine control unit, and the power supply control unit to each other.

11. The outboard motor according to claim 1, wherein the engine control unit and the power supply control unit are communicably connected to each other by the communication cable based on a CAN communication standard.

12. The outboard motor according to claim 1, further comprising a driver disposed below the one of the engine control unit and the power supply control unit on the first side surface of the engine and that drives an electrical component of the engine.

13. The outboard motor according to claim 1, further comprising a starter mounted on a third side surface of the engine that faces the first side surface and that starts the engine.

14. The outboard motor according to claim 1, wherein the first side surface of the engine on which the one of the engine control unit and the power supply control unit is mounted is a side surface of a crankcase of the engine.

15. A marine vessel comprising:

a vessel body;

an outboard motor mounted on the vessel body;

a mounting bracket that fixes the outboard motor to the vessel body; and an external control unit; wherein the outboard motor includes:

an engine including a cylinder that reciprocates in a horizontal or substantially horizontal direction;

a cowling that covers the engine;

a control unit including an engine control unit and a power supply control unit; and a communication cable that communicably connects the engine control unit to the power supply control unit; wherein the engine control unit includes a first controller;

the power supply control unit is configured or programmed to communicate with the engine control unit and includes a second controller;

one of the engine control unit and the power supply control unit is mounted on a first side surface of the engine, and the other of the engine control unit and the power supply control unit is mounted on an upper surface of the engine;

the engine control unit and the power supply control unit are configured or programmed to communicate with the external control unit via the communication cable; and the external control unit is arranged on the mounting bracket.

16. The marine vessel according to claim 15, wherein the external control unit includes a steering controller configured or programmed to control steering of an outboard motor body with respect to the vessel body.

17. The marine vessel according to claim 15, wherein the external control unit includes a remote control provided on the vessel body.

18. The marine vessel according to claim 15, wherein the first side surface of the engine on which the one of the engine control unit and the power supply control unit is mounted is a side surface of a crankcase of the engine.

* * * * *